US007874780B2

(12) United States Patent
Willauer

(10) Patent No.: US 7,874,780 B2
(45) Date of Patent: Jan. 25, 2011

(54) MACHINE AND METHOD FOR MAKING LAY-FLAT PHOTO BOOKS

(76) Inventor: Kelly Willauer, 241 York St., Dubuque, IA (US) 52203

( * ) Notice: Subject to any disclaimer, the term of this patent is extended or adjusted under 35 U.S.C. 154(b) by 424 days.

(21) Appl. No.: 11/862,260

(22) Filed: Sep. 27, 2007

(65) Prior Publication Data

US 2009/0087283 A1 Apr. 2, 2009

(51) Int. Cl.
*B42C 9/00* (2006.01)

(52) U.S. Cl. ..... 412/8

(58) Field of Classification Search ..... 412/6, 412/8, 33, 36, 37; 281/21.1, 36, 40; 270/28.07
See application file for complete search history.

(56) References Cited

U.S. PATENT DOCUMENTS 4,898,506 A 2/1990 Lazar
4,968,203 A 11/1990 Lazar
5,655,866 A 8/1997 Bellanca
5,779,423 A 7/1998 Bermingham
6,447,013 B1 * 9/2002 Francesco ..... 281/21.1
2004/0066030 A1 * 4/2004 Parker ..... 281/21.1
2005/0109464 A1 * 5/2005 Silverbrook ..... 156/384
2006/0061083 A1 3/2006 Didde

OTHER PUBLICATIONS

Efficient solutions for value-added products "Photo books by Durst", International Contact, p. 18 (Feb./Mar. 2007) 1 page.

* cited by examiner

*Primary Examiner*—Dana Ross
*Assistant Examiner*—Matthew G Katcoff
(74) *Attorney, Agent, or Firm*—McKee, Voorhees & Sease, P.L.C.

(57) ABSTRACT

A machine and method are provided for making a lay-flat book or album with multiple pages. The machine includes a base with first and second supports. Paper forming the book pages is creased and placed front face down upon the supports and held in position by a vacuum. An adhesive is applied to the back of one page, and then the supports pressed together to adhere the pages together. Hydraulic or pneumatic cylinders move the supports, as controlled by electrical or electronic circuitry in a control panel. Thus, a semi-automatic process is provided for gluing the book pages together.

9 Claims, 5 Drawing Sheets

MACHINE AND METHOD FOR MAKING LAY-FLAT PHOTO BOOKS

FIELD OF THE INVENTION

The present invention relates to a machine and a method for making photo albums or books having lay-flat pages wherein a digital photo can extend across the fold of a page.

BACKGROUND OF THE INVENTION

Digital photography and printing have expanded a variety of options for photo albums. One popular album is known as a lay-flat book wherein the opened pages are formed by a continuous sheet of paper with a folded crease in the center, but without a center page break or cut. This lay-flat book allows a photograph to be printed on the page so as to extend from the left half of the page, over the crease, and onto the right hand side of the page. Thus, large photographs, including panoramic views, can be printed substantially across the full width of the opened book or album, without having a center gap as in conventional photo albums wherein the left hand and right hand pages extend substantially one half the width of the open book.

In lay-flat books, the backs of adjacent pages are glued or otherwise adhered together in a double thick layer having two sheets of paper per page. However, there are not any machines which can quickly and easily accomplish the page gluing process for lay-flat books, at a reasonable cost.

Therefore, a primary objective of the present invention is the provision of a machine for making a lay-flat book.

Another objective of the present invention is the provision of an improved method for making a lay-flat book.

Still another objective of the present invention is the provision of a machine having a pair of page supports which can be opened and closed for gluing the backs of creased pages together.

Yet another objective of the present invention is the provision of a machine and method which is at least partially automated for making the pages of a lay-flat book.

Still another objective of the present invention is the provision of a machine and method for making pages of a lay-flat book, including an adhesive station which provides quick and easy application of adhesive to the appropriate page surface.

A further objective of the present invention is the provision of a machine and method for making lay-flat books which utilizes a vacuum to maintain the book pages in a desired position during the process.

Yet another objective of the present invention is the provision of a machine and method for making a lay-flat book wherein page supports are automatically moved along tracks for adhering adjacent pages together.

Still another objective of the present invention is the provision of a machine and method for making lay-flat books which includes page supports which are moved by extensible and retractable cylinders.

Another objective of the present invention is the provision of a machine and method for making lay-flat books having an adhesive station to control application of adhesive to the book pages.

A further objective of the present invention is the provision of a machine and method for making lay-flat book pages which is economical and efficient, and which makes durable book pages.

These and other objectives will become apparent from the following description of the invention.

BRIEF SUMMARY OF THE INVENTION

The machine of the present invention makes a lay-flat book with pages having front and back faces and a central crease, which defines opposite sides on each face. The machine includes a base, with first and second page supports. The supports include horizontal and vertical surfaces along with the creased pages extend. The support surfaces are perforated, with a vacuum applied thereto so as to hold the pages in position on the page supports.

The machine includes an adhesive station on the base to apply adhesive to one side of the back face of one of the pages. At least one of the supports is movable from an open position spaced from the other support, to a closed position wherein the pages on each support are pressed together so as to adhere one side or half of the back face of each page together. The machine includes tracks for guiding the movement of the supports, extendible and retractable cylinders to actuate movement of the supports, and a control panel to control movement of the page supports.

In the method of the present invention, first and second pages are placed face down onto the first and second supports so that half the page resides adjacent the vertical support surface and the other half of the page extends along the horizontal support surface of each support. One support is moved to the adhesive station, wherein adhesive is applied to the first side of the back face of one page. After the adhesive is applied, the support is moved away from the adhesive station. Then, one of the supports is moved towards the other so that the first side of the back face of the first page is compressed against the first side of the back face of the second page, thereby adhering the pages together. The resulting, adhered pages allow the first and second sides of the front face of each page to lay open simultaneously.

DETAILED DESCRIPTION OF THE DRAWINGS

Figure 1:
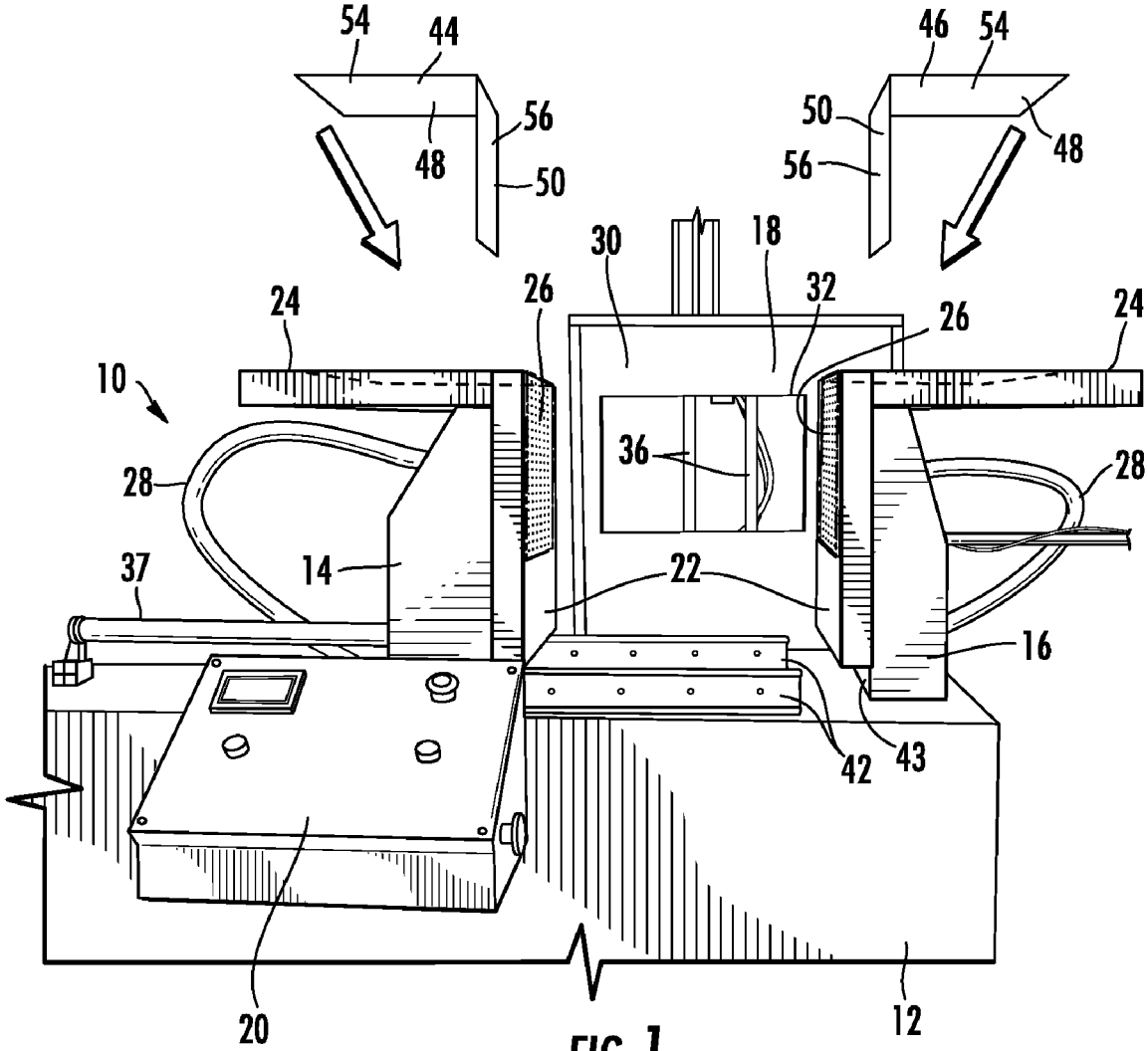
FIG. 1 is a front elevation view of the machine of the present invention used for making a lay-flat book.
Figure 2:
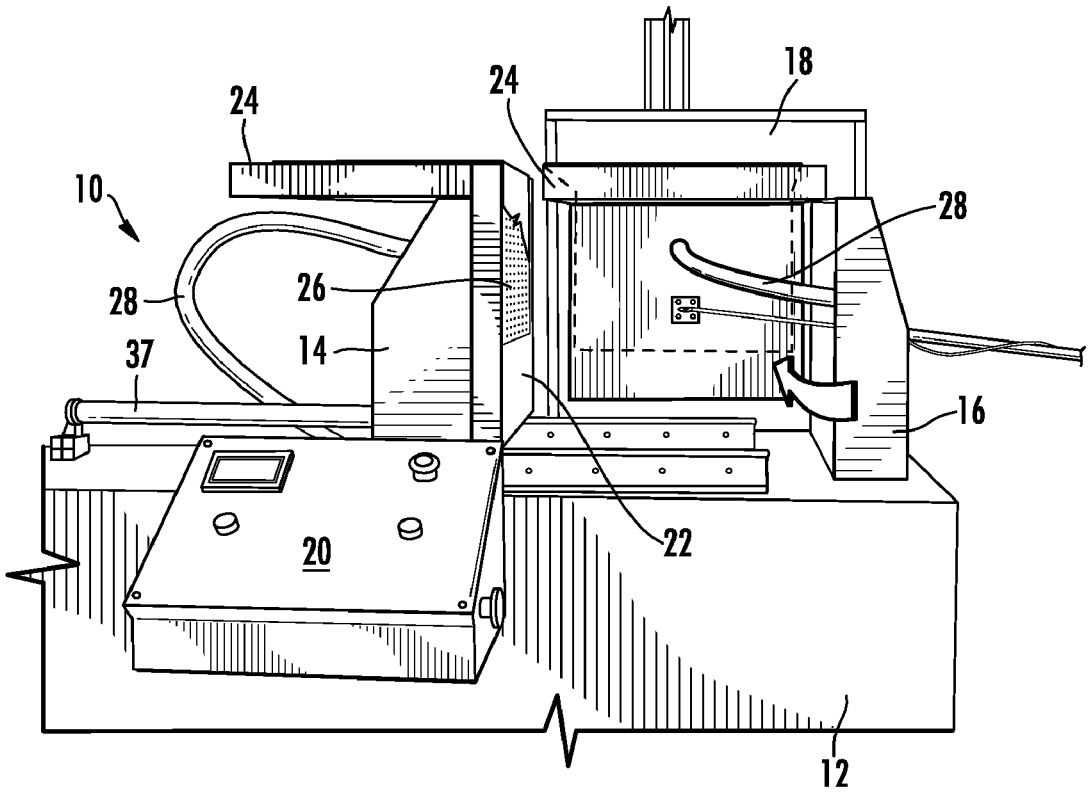
FIG. 2 is a view similar to FIG. 1 illustrating movement of one of the page supports towards the adhesive station.

The lay-flat book making machine of the present invention is generally designated in the drawings by the reference numeral 10. The machine 10 includes a base 12, with a left hand page or paper support 14, and a right hand support 16. The machine 10 also includes an adhesive station 18, and a control panel 20 for controlling operation of the machine.

Each of the supports 14, 16 include a vertical wall 22 and a horizontal shelf 24. The wall 22 and shelf 24 of each support 14, 16 include a perforated area 26. Hoses 28 are connected to each of the supports 14, 16 and to a vacuum source (not shown) in the base 12 of the machine 10 so as to create a vacuum through the perforations of the wall 22 and shelf 24 of each support 14, 16.

The adhesive station 18 includes a vertical wall 30 with a window or cut out 32. A spray nozzle 34 is mounted behind the window 32 so as to direct a spray of adhesive material through the window 32, as described below. The spray nozzle 34 may be mounted on one or more tracks or rails 36 in the adhesive station 18 so as to be movable relative to the window 32. A first hose 38 supplies liquid adhesive to the nozzle 34, while a second hose 40 provides pressurized air to the nozzle 34 so as to atomize the liquid adhesive.

Figure 4:
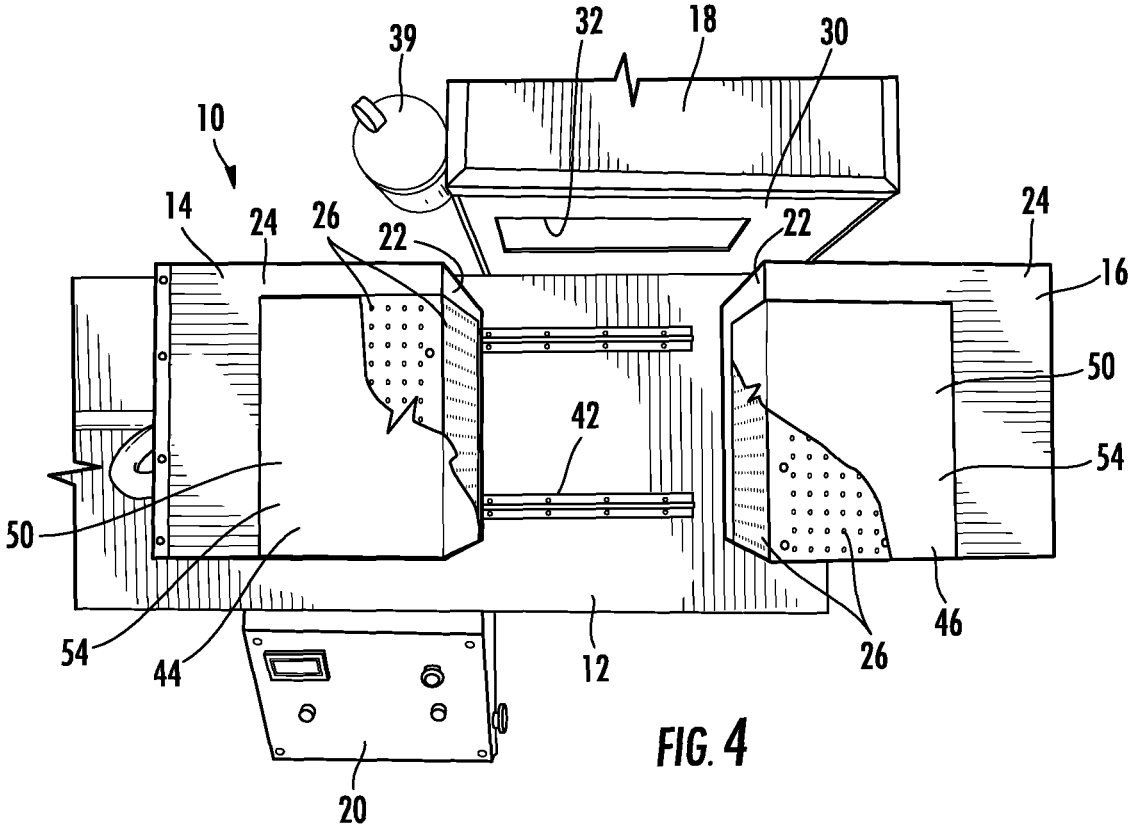
FIG. 4 is a top plan view of the machine, with the page supports in an initial position.
Figure 5:
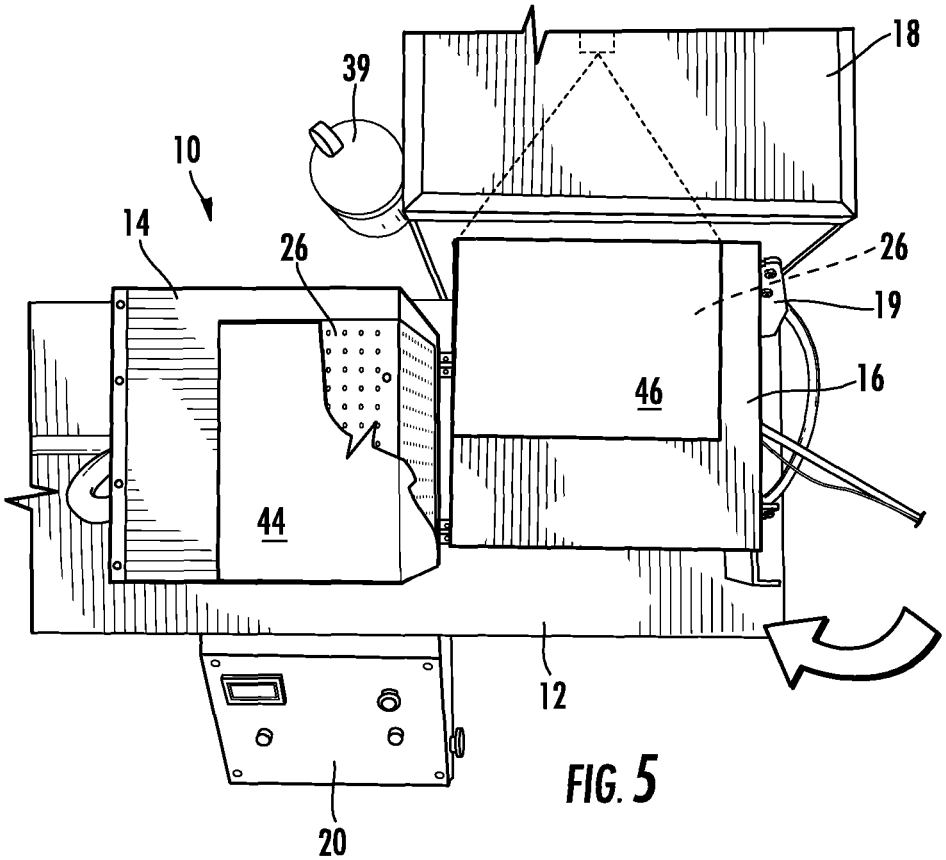
FIG. 5 is a top plan view of the machine showing one of the supports moved to the adhesive station.

In a preferred embodiment, the right hand support 18 is pivotally connected to the spray station wall 30 by one or more hinges 19 for movement approximately 90° between an open position, as shown in FIGS. 1 and 4, and a closed position, as shown in FIG. 5. In the open position, the wall 22 of the support 16 is spaced from the window 32 of the spray station 18. In the closed position, the wall 22 of the support 16 is adjacent the window 32 of the spray station 18. Movement of the right hand support 16 relative to the spray station 18 is accomplished in a preferred embodiment with an extendable and retractable hydraulic or pneumatic cylinder (not shown). As an alternative to moving the support 16 toward and away from the adhesive station 18, such movement can be reversed wherein the adhesive station 18 will move relative to the support 16. As a further alternative, the spray nozzle 34 can be mounted on a robotic arm for movement into a spraying position relative to the support 16.

Figure 3:
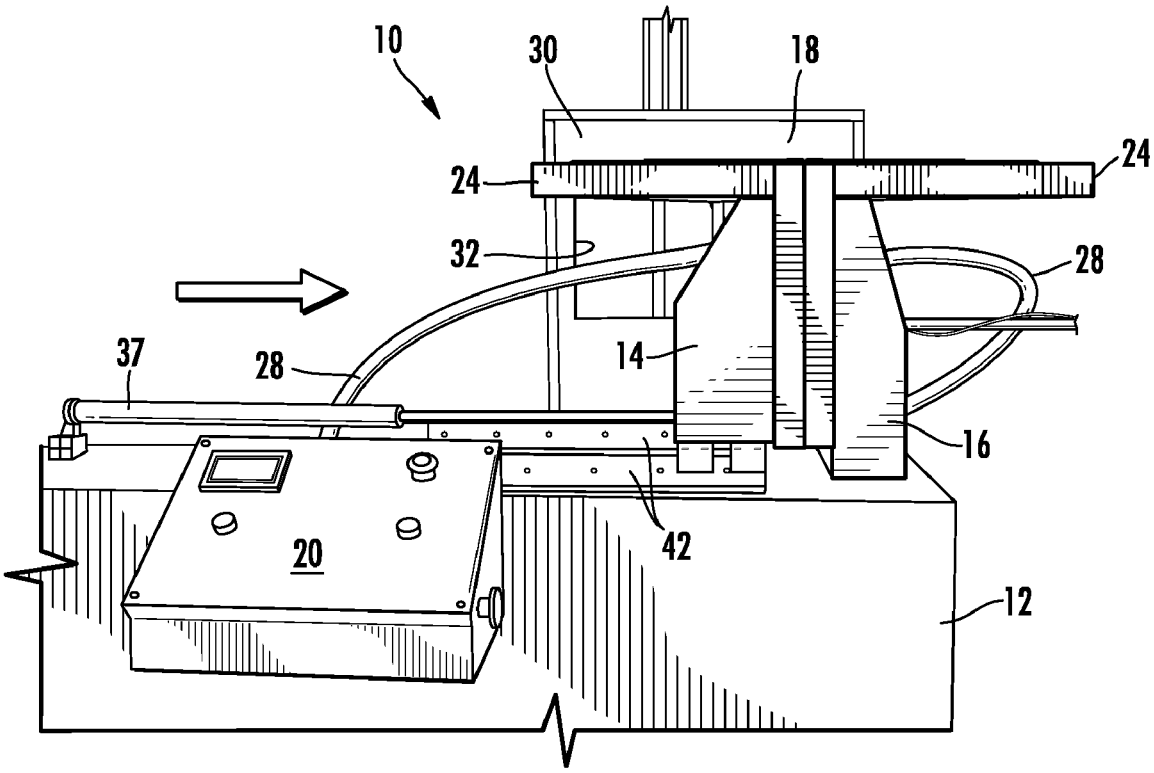
FIG. 3 is a front elevation view showing the machine with the supports moved together to compress the pages together.
Figure 6:
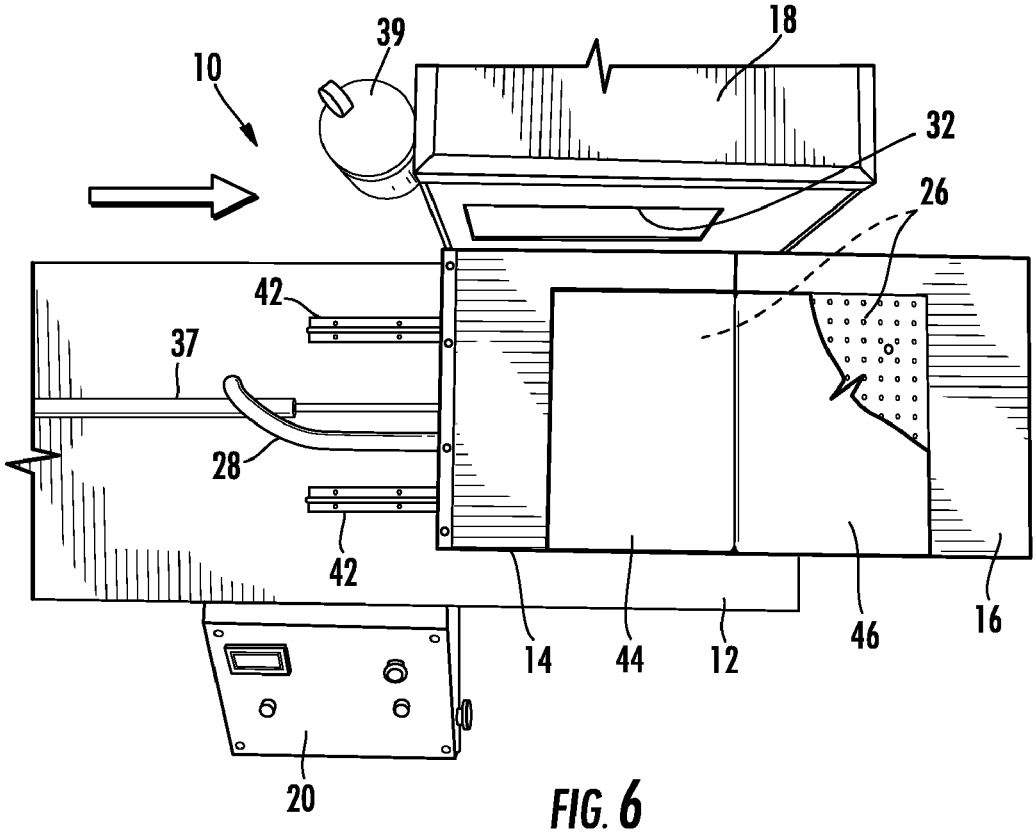
FIG. 6 is a top plan view showing the supports in the closed position for adhering pages together.
Figure 7:
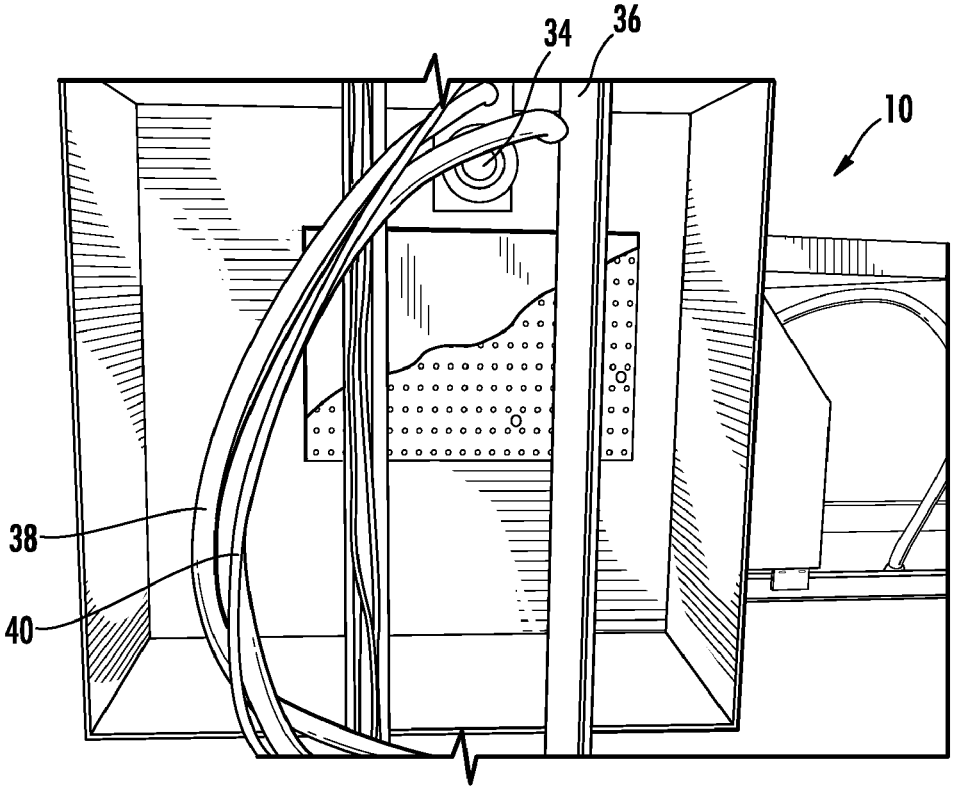
FIG. 7 is an enlarged rear elevation view of the adhesive station of the machine.

The left hand support 14 is mounted on a pair of tracks or rails 42 for movement forward and away from the right hand support 16. In a first initial position, the left hand support 14 is spaced from the right hand support 16, as seen in FIGS. 1 and 4. In a second position, the left hand support 14 is moved into engagement with the right hand support 16, as seen in FIGS. 3 and 6. Movement of the support 14 is accomplished via an extendable and retractable hydraulic or pneumatic cylinder 37. The control panel 20 controls movement of the supports 14, 16 via appropriate electrical circuitry, and/or computer software.

A substrate, preferably paper, is used to form the pages of the book. FIGS. 1-6 illustrate the steps for making the first two pages of the lay-flat book. More particularly, first and second pieces of paper 44, 46 having a front face 48 and a back face 50 are folded along a mid-line so as to form a crease 52, which defines first and second sides 54, 56 of each face. The papers or pages 44, 46 are placed with the front faces 48 facing down so that the first sides 54 rests upon the shelves 24 and the second sides 56 reside along the vertical walls 22 of the left and right supports 14, 16. The right support 16 is then pivoted to the closed position, such that the second side 56 of the back face 50 of the second paper 46 is adjacent and in front of the window 32 of the adhesive station 18. During such pivotal movement, the support 16 moves past the front track 42 and has a lower notch 43 to accommodate the rear track 42. The spray nozzle 34 is then activated so as to apply a layer of adhesive onto the second side 56 of the back face 50 of the second paper 46. The right support 16 is then pivoted away from the adhesive station 18 to the open position. Then, the left support 14 is moved by the cylinder 37 along the tracks 42 into pressing engagement with the right support 16, such that the second side 56 of the back face 50 of the first paper 44 is pressed against a second side 56 of the back face 50 of the second paper 46 for adhesion thereto. The vacuum to the right support 16 can then be discontinued, so that when the left support 14 is retracted, the second page 46 is free to slide off of the right support 16. A new creased sheet of paper is then placed on the right support 16, and the process repeated until the desired number of pages for the book is formed.

Figure 8:
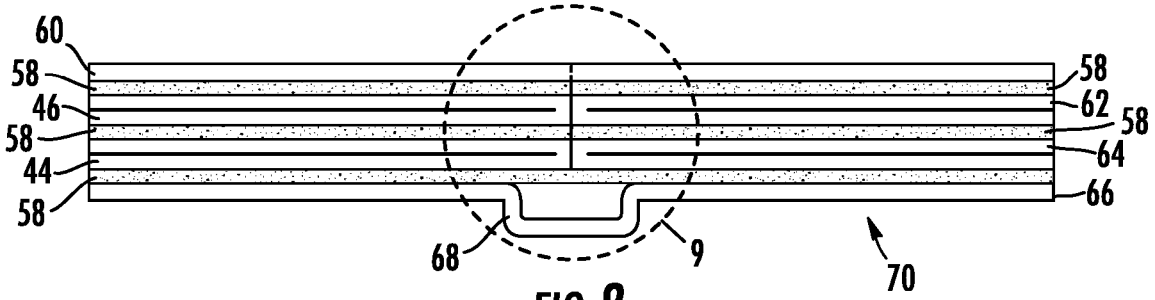
FIG. 8 is a view of several pages of a lay-flat book glued together according to the present invention.
Figure 9:
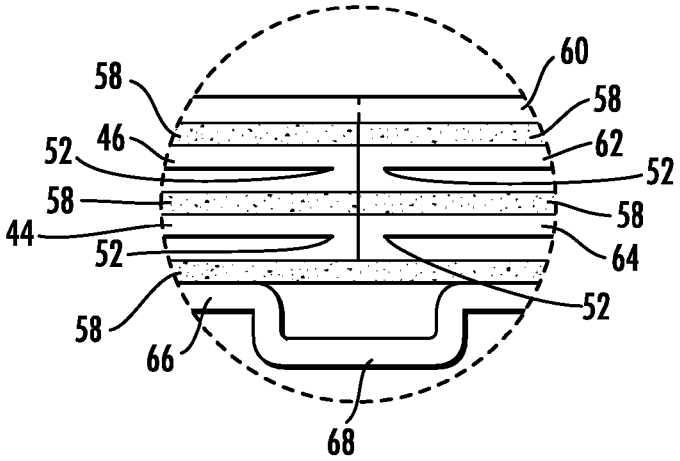
FIG. 9 is an enlarged view of the center of the book showing the multiple pages glued together.

FIGS. 8 and 9 show a lay-flat book 70 with several pages glued together using the machine 10 and method of the present invention. The first page 44 is glued or adhered to the second page 46 by a layer of adhesive 58. Similarly, layers of adhesive 58 are provided between the second page 46 and the third page 60, between the third page 60 and the fourth page 62, and between the fourth page 62 and the fifth page 64. In FIG. 8, the third page 60 is shown in the lay-flat open position. The creases 52 allow the pages 44, 46, 60, 62 and 64, respectively, to be folded into closed positions. A book cover 66 is adhered to the first and last pages with a spine 68 which allows the book 70 to be closed.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of making a lay-flat book, comprising:

creasing first and second pages having front and back faces, so as to define first and second sides for each face;

placing the first and second pages front face down onto first and second supports;

applying adhesive to the first side of the back face of the first page;

moving one of the supports toward the other support whereby the first side of the back face of the first page is compressed against the first side of the back face of the second page so as to adhere the pages together;

whereby the first and second sides of the front face of each page will lay open flatly.

2. The method of claim 1 wherein the first support pivots approximately 90°from a first position to a second position for application of the adhesive.

3. The method of claim 1 wherein each support is perforated, the method further comprising providing a vacuum to the supports to hold the pages in place on the supports.

4. The method of claim 1 wherein the application of adhesive is an automated process.

5. The method of claim 1 wherein the movement of the support is an automated process.

6. The method of claim 1 wherein the movement of the support is along a track.

7. The method of claim 1 wherein the movement of the support is through an extensible cylinder.

8. The method of claim 1 wherein the supports each have an upper horizontal shelf and a vertical wall, the placement of the pages on the supports includes positioning the second side of the front face of each page onto the shelf such that the first side of the front face of each page hangs adjacent the vertical wall of the respective supports.

9. The method of claim 1 further comprising moving the one support away from the other support and removing the pages.

* * * * *